United States Patent [19]

Boutet et al.

[11] 4,223,738

[45] Sep. 23, 1980

[54] PRODUCTION WELL-HEADS FOR UNDERWATER OIL WELLS

[75] Inventors: Jean-Pierre L. Boutet, Paris; Francois C. Gueuret, Boulogne Billancourt, both of France

[73] Assignee: Compagnie Francaise des Petroles, Paris, France

[21] Appl. No.: 946,920

[22] Filed: Sep. 28, 1978

[30] Foreign Application Priority Data

Sep. 29, 1977 [FR] France ..... 77 29256

[51] Int. Cl.[2] ..... E21B 7/12

[52] U.S. Cl. ..... 166/368; 166/75 A; 166/89

[58] Field of Search ..... 166/75 A, 89, 348, 368; 285/133 A

[56] References Cited

U.S. PATENT DOCUMENTS

| | | | |
|---|---|---|---|
| 1,863,890 | 6/1932 | Wigle | 166/89 |
| 3,151,680 | 10/1964 | Parkhurst et al. | 166/89 |
| 3,311,168 | 3/1967 | Pierce, Jr. | 166/89 |
| 3,489,213 | 1/1970 | Hutchison | 166/348 |
| 3,693,714 | 9/1972 | Baugh | 166/348 |

*Primary Examiner*—Ernest R. Purser
*Assistant Examiner*—Richard E. Favreau
*Attorney, Agent, or Firm*—Sughrue, Rothwell, Mion, Zinn and Macpeak

[57] ABSTRACT

In a production well-head for an underwater oil well the suspension head of the innermost tubing, which has a frusto conical surface on which the production tube suspension member seats, has a duct leading from the enclosed space between the innermost tubing and the tubing adjacent thereto, to the interior of the innermost tubing, and a duct communicating therewith is provided in the suspension member.

8 Claims, 4 Drawing Figures

PRODUCTION WELL-HEADS FOR UNDERWATER OIL WELLS

This invention relates to improvements in production well-heads for underwater oil wells and, more particularly, to an arrangement whereby the annular space between the innermost tubing and the tubing adjacent thereto can be drained.

In order to prevent fluids from the field from rising outside the innermost tubing, and in order to fix the end thereof at the top of the stratum, the bottom part of the space between this tubing and the adjacent tubing is closed by cement. The suspension heads of the innermost tubing and the adjacent tubing each have a gasket bearing against the inner wall of the head of the casing, so that an enclosed space is formed which, in the case of well-heads on land, communicates with an external valve so that the mud contained in this space can, for example, be pumped away or simply discharged. This eliminates any excess pressure which may occur when the well is brought into production, because of the heating of the innermost tubing as a result of the oil effluents passing therethrough, with consequent heating of the mud in the enclosed space between the innermost tubing and the adjacent tubing.

Safety reasons in particular, in the case of underwater oil wells, make it impossible to establish communication between this enclosed space and a valve outside the body of the well-head, so that the resistance to pressure of the tubings, casing and gaskets is increased. This has considerable disadvantages. For example the resistance of the tubing to the very great increase in pressure, which might result in damage to the string by bursting or crushing, can be achieved only by a considerable increase in weight—and hence cost—of the tubing. Also, the increased tubing thickness means that the inside diameter of the tubing is reduced, so that in some cases there is a likelihood of the production tube diameter having to be reduced.

Also, irrespective of the precautions taken, the gaskets at the well-head have to withstand very considerable pressures which tends to damage them.

It is an object of this invention to obviate these disadvantages while avoiding any risk of damage to the tubing and gaskets, by eliminating any excess pressure, by providing an internal passage providing communication between the enclosed space between the innermost tubing and the tubing adjacent thereto, with a space directly or indirectly communicating with the surface.

According to the present invention there is provided a production well-head for an underwater oil well comprising a housing, a plurality of tubings each provided with a suspension head, sealing means between said suspension head and said housing, a production tube, a suspension member for suspending said production tube from said suspension head of the innermost one of said tubings, said suspension member having a frusto-conical surface bearing on a frusto-conical surface of said suspension head, and cement means for sealing between said innermost tubing and said tubing adjacent thereto at the lower end thereof, the improvement wherein a duct is provided in said suspension head of said innermost tubing, said duct communicating with the space between said innermost tubing and the tubing adjacent thereto and with the interior of said innermost tubing.

Thus unlike prior solutions, in which the walls and the gaskets of the space are reinforced to withstand a considerable pressure increase, and unlike the solutions adopted on land, in which the enclosed space communicates with an external valve via a duct formed in the actual well-head body, the present invention enables the space between the innermost tubing and the tubing adjacent thereto to be drained, by providing a suspension head for the innermost tubing which is provided with at least one duct connecting the space between the two tubings and closed at the base, to the space within the innermost tubing.

An auxiliary enclosed space may be provided which serves as an intermediate passage between the opening of the duct in the suspension head of the innermost tubing and the opening of a duct in the suspension head for the production tubes and giving access to the surface.

It is sufficient to provide a toric auxiliary space at the openings of the ducts so that, irrespective of the respective orientations of the suspension head for the innermost tubing and the suspension member for the production tubes, the auxiliary space overlaps the openings of the duct in the suspension head of the innermost tubing and the duct in the suspension member. It is thus exteremely simple to pump or drain the enclosed space without the use of complex devices.

The auxiliary space may be defined at least by a lower cylindrical part of the suspension member and a gasket bearing against the innermost tubing.

If the suspension member has an upper gasket all that is required is to provide gaskets beneath the openings of the ducts for example on a lower cylindrical part of the suspension member, thus conveniently forming a sealed auxiliary space simply by lowering the suspension member on to the suspension head of the innermost tubing.

The invention will be more fully understood from the following description of embodiments thereof, given by way of example only, with reference to the accompanying drawings.

Figure 1:
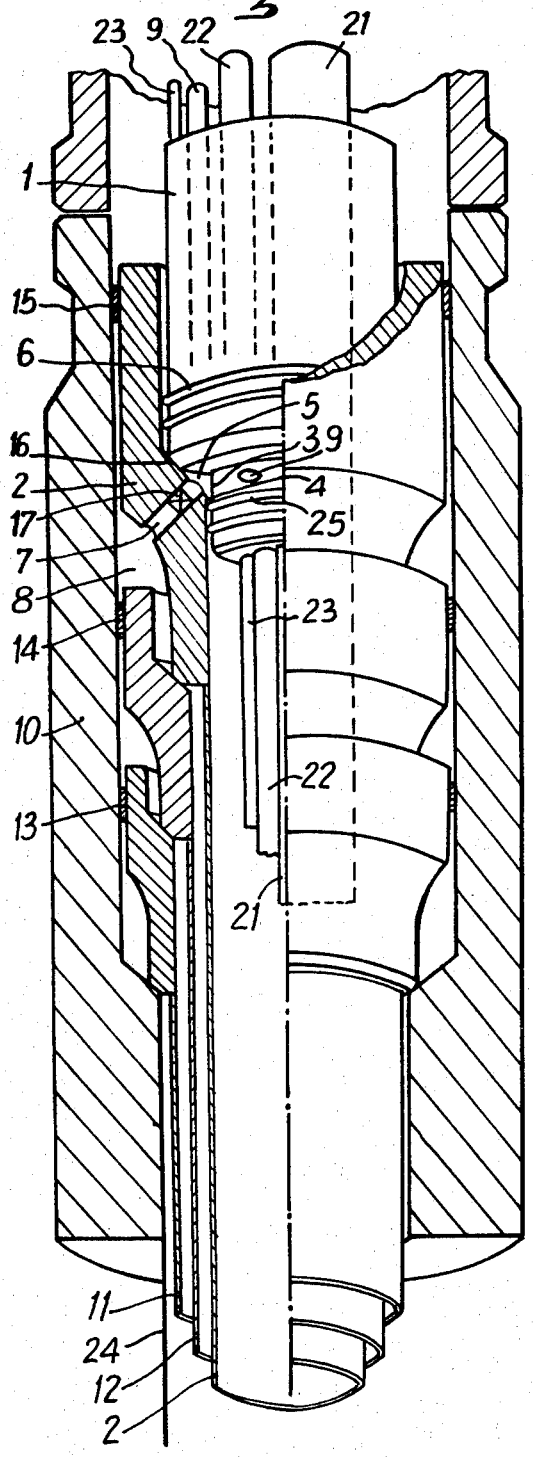
FIG. 1 is a diagrammatic and partial section of part of an embodiment of an underwater oil well-head according to the present invention and along a vertical plane of symmetry.
Figure 2:
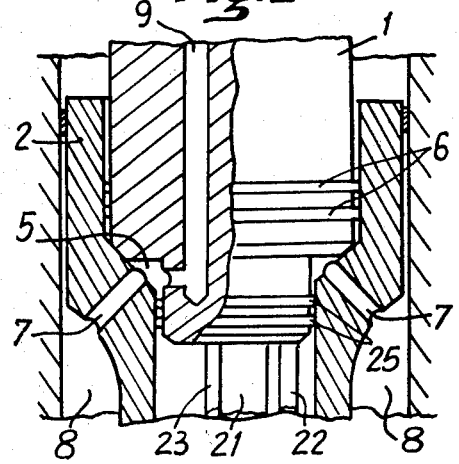
FIG. 2 is an axial section through the suspension member of the well-head of FIG. 1 to the invention.

The sealed suspension assembly for an underwater oil well-head illustrated in FIGS. 1 and 2 comprises a casing 24 and a housing 10 supporting a first tubing 11, the penultimate tubing 12, and the last or innermost tubing 2. The bottom part of the space between the tubings 12 and 2 is sealed by means of cement. The gaskets 13, 14 and 15 provide sealing between the housing 10, casing 24 and tubings 11, 12 and 2 respectively.

When the well is in operation, the mud contained in the space 8 between the housing 10, gaskets 14 and 15, tubings 12 and 2 and the cement poured inbetween the bottom parts of the tubings 12 and 2, heats up because of the flow of the oil effluents, and the duct 7 in the head of the last tubing 2 enables the mud to be discharged to an auxiliary space from whence it can be fed to an appropriate passage.

In a preferred embodiment of the invention, the duct 7 is so situated as to discharge beneath the conical bearing surface 16 of the suspension member 1. To provide a sealed auxiliary space, the cylindrical part 3 of the wall of the suspension member situated beneath the level of the opening of the duct 7, and the cylindrical part 4 of the inner wall of the tubing 2, are suitably adapted the cylindrical part 3 being provided with gaskets 25 co-operating with the cylindrical part 4 of the tubing 2. In this way, an auxiliary space 5 is defined between the top and bottom gaskets 6, 25 respectively of the suspension member, into which the duct 7 opens. The pressurised mud from space 8 can be withdrawn from this auxiliary space.

To this end, in the preferred embodiment, at least one duct 9 is provided in the member 1 and opening into the auxiliary space 5. In this way it is an easy matter at any time to drain the space 5 or carry out other operations, e.g. pumping a fluid to the annular space 8.

Figure 3:
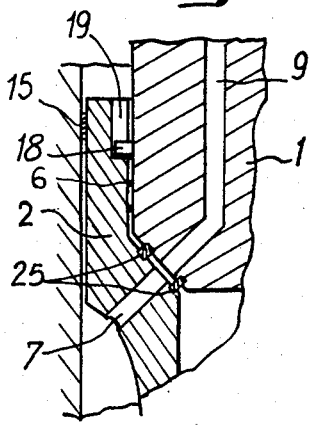
FIGS. 3 and 4 illustrate two variants the arrangement shown in FIG. 2.
Figure 4:
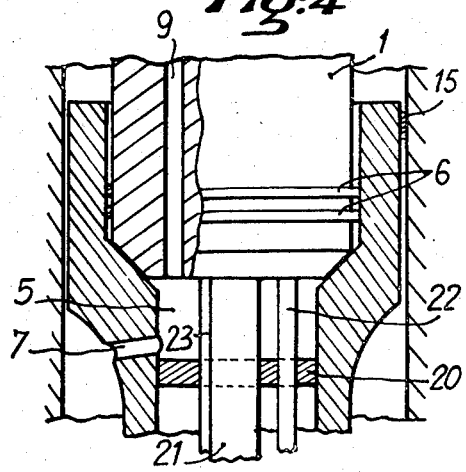

Of course the invention covers cases in which the means used above are replaced by equivalent means. For example as shown in FIG. 3, the ducts 7 and 9 could be placed in communication by so orientating the suspension member 1, e.g. by means of a lug 18 sliding in a guide slot 19 formed in the tubing 2, that the openings of the ducts 7 and 9 coincide, the toric space 5 then being unnecessary and the gaskets 25 being disposed around the openings of said ducts. Similarly, the bottom gaskets 25 between the lower conical part of the suspension member 1 and the inner wall of the last tubing 2 could be replaced by an expanding sealing plug 20 as shown in FIG. 4 attached to the tubing 21. While allowing the passage of the hydraulic lines 23 for controlling the well bottom safety valves, the conduit 22 for the effluents in the annular space between the production tube 21 and the last tubing 2, and any other line which may be necessary for the well control and production operations, said plug 20 together with the top gaskets 6 of the suspension member 1 defines the auxiliary space 5 into which the ducts 7 open for draining the annular space 8, the discharge ducts 9 leading to the bottom part of the member 1 without the member having to have any particular orientation. If required the ducts 7 may have automatic control valves 17 (FIG. 1) for the discharge and/or for signalling if a predetermined pressure is exceeded.

What is claimed is:

1. In a production well-head for an underwater oil well comprising a housing, a plurality of concentric tubings each provided with a suspension head, sealing means between each suspension head and said housing, a production tube, a suspension member for suspending said production tube from a suspension head of an innermost one of said tubings, said suspension member having a frusto-conical surface bearing on a frusto-conical surface of said suspension head of the innermost one of said tubings, and cement means for sealing between said innermost tubing and an outer tubing adjacent thereto at the lower end thereof, the improvement characterized by: a duct provided in said suspension head of said innermost tubing, said duct communicating with the space between said innermost tubing and the outer tubing adjacent thereto and with the interior of said innermost tubing, and said duct opening into an auxiliary space within said innermost tubing delimited by upper sealing means disposed between said suspension member and said suspension head of said innermost tubing and a lower sealing means bearing against said innermost tubing.

2. The improvement as claimed in claim 1, including a further duct provided in said suspension member, which further duct opens into said auxiliary space level with the opening of said duct in said suspension head of said innermost tubing, said upper sealing means comprising at least one gasket provided on an upper cylindrical part of said suspension member and said further duct in said suspension member opening at a level below said upper cylindrical part.

3. The improvement as claimed in claim 2, wherein said lower sealing means comprise gaskets provided on a lower cylindrical part of said suspension member below said frusto-conical part thereof, which gaskets bear against an inner cylindrical part of said innermost tubing below said frusto-conical part thereof, a zone between said inner cylindrical part and said frusto-conical part of said innermost tubing forming said auxiliary space.

4. The improvement as claimed in claim 2, wherein said lower sealing means comprises a sealing plug, the periphery of which bears against a wall of said innermost tubing below its frusto-conical part and which is provided with sealing-tight passages for a production tubing, a conduit for an annular space between the production tubing and the innermost tubing, and conduits for hydraulic controls, a zone between said sealing plug and said frusto conical surface of said suspension member forming said auxiliary space.

5. The improvement as claimed in claim 3 or claim 4, wherein said further duct in said suspension member opens in a lower surface thereof.

6. The improvement as claimed in claim 4, wherein said duct in said suspension head of said innermost tubing opens below said frusto-conical part thereof.

7. In a production well-head for an underwater oil well comprising a housing, a plurality of concentric tubings each provided with a suspension head, sealing means between each suspension head and said housing, a production tube, a suspension member for suspending said production tube from a suspension head of an innermost one of said tubings, said suspension member having a frusto-conical surface bearing on a frusto-conical surface of said suspension head of the innermost one of said tubings, and cement means for sealing between said innermost tubing and an outer tubing adjacent thereto at the lower end thereof, the improvement characterized by: a first duct provided in said suspension head of said innermost tubing, said duct communicating with the space between said innermost tubing and the outer tubing adjacent thereto and with the interior of said innermost tubing, said suspension member being provided with a second duct and with a lug, and the upper part of said innermost tubing having a guide slot for said lug, the opening of said first duct in said suspension head of said innermost tubing coinciding in sealing-tight relationship with the opening of said second duct in said suspension member, when said suspension member is assembled with said suspension head.

8. The improvement as claimed in claim 7, wherein said ducts open in said frusto-conical surfaces of said suspension member and said suspension head respectively.

* * * * *